United States Patent [19]

Matthias

[11] 4,109,323

[45] Aug. 29, 1978

[54] PROTECTIVE HELMET

[75] Inventor: Jan Henner Matthias, Gries, Pinzgau, Austria

[73] Assignee: Porsche Design Ferdinand A. Porsche, Austria

[21] Appl. No.: 855,659

[22] Filed: Nov. 30, 1977

[30] Foreign Application Priority Data

Dec. 7, 1976 [AT] Austria ..... 9057/76

[51] Int. Cl.[2] ..... A42B 3/02

[52] U.S. Cl. ..... 2/410; 219/200; 219/211

[58] Field of Search ..... 2/410, 411, 412, 422, 2/425; 338/226; 219/200, 201, 211; 83/15, 16, 170, 171; 53/36; 156/275; 225/93.5

[56] References Cited

U.S. PATENT DOCUMENTS

| | | | |
|---|---|---|---|
| 3,204,385 | 9/1965 | De Remer et al. | 53/36 X |
| 3,348,640 | 10/1967 | Thompson et al. | 156/275 X |

*Primary Examiner*—Werner H. Schroeder
*Assistant Examiner*—Moshe I. Cohen
*Attorney, Agent, or Firm*—Townsend and Townsend

[57] ABSTRACT

The invention relates to a protective helmet having a helmet shell resistant to mechanical stress. The helmet shell is composed at least partially of meltable material and is provided along at least one of its separating lines with an elongate separating device in the form of an electrical resistor element, said separating device being provided with at least two terminals to which an electric current source is connectable.

5 Claims, 1 Drawing Figure

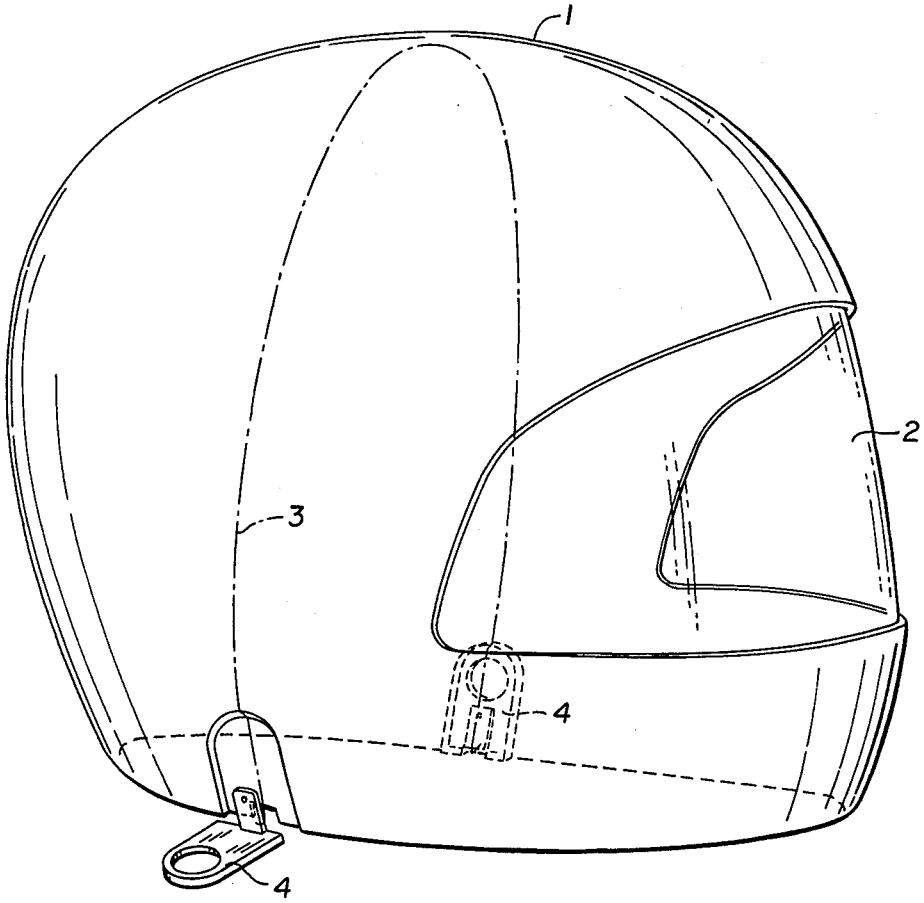
1
2
3
4
4

PROTECTIVE HELMET

The invention relates to a protective helmet, in particular for motorcyclists and skiers, with a helmet shell resistant to mechanical stress.

It is a disadvantage of conventional protective helmets that considerable force must be applied to remove them from the head of an injured wearer. This application of force may substantially aggravate the injuries sustained in an accident and in certain types of injuries may be fatal to the wearer.

It is the object of the invention to eliminate this disadvantage and to provide a protective helmet which secures easy removal from the head of an injured wearer.

This object is achieved according to the invention by providing an elongate separating device in the form of an electrical resistor element, preferably a resistance wire or resistance strip, along at least one of the separating lines in or on the helmet shell which consists at least partially of meltable material, preferably of thermoplastic plastic material, said separating device being provided with at least two poles or terminals to which an electric current source, for instance a battery or a generator, is connectable.

This measure permits melting of the helmet shell of the protective helmet along the resistor element and thus separating it into two parts easily removable from the head of the wearer in case of an accident, thus preventing, with reasonable safety, an aggravation of possible injuries sustained by the wearer.

It is particularly advantageous to arrange at least one of the separating lines of the helmet shell so that it extends in a separating plane positioned essentially vertically to the longitudinal axis of the helmet shell and at least approximately in the longitudinal center thereof.

According to another preferred embodiment of the invention, the helmet shell consists of only one separating zone incorporating the resistor element and composed of material comparatively easy to melt, while the remaining zones of the helmet shell are composed of a material which is infusible or comparatively difficult to melt.

The invention is explained in detail under reference to the accompanying diagrammatic drawing showing a perspective view of a protective helmet according to the invention.

In the drawing, the helmet shell bears the reference number 1, while the visor of the protective helmet is designated with 2. According to the invention, an elongate separating device 3 having the form of an electrical resistor element, preferably a resistance wire or resistance strip, is provided along at least one of the separating lines in or on the helmet shell which consists at least partially of meltable material, preferably of thermoplastic plastic material, said separating device 3 being provided with at least two poles or terminals 4 to which an electric current source, for instance a battery or generator, is connectable. The resistor element 3 extends along a separating line which preferably runs from one lateral rim of the helmet shell to the other lateral rim thereof. Of course it is also possible to provide a plurality of resistor elements along a plurality of separating lines of the helmet shell. The electrical resistor element which is preferably formed of a resistance wire is preferably embedded into the helmet shell in such a manner that it is surrounded by the material of the helmet shell in its entire circumference. But is is equally possible to only partially embed an electrical resistor element into the helmet shell or to attach the resistor element to the outside thereof. In all cases described, however, the helmet shell must be of comparatively easily meltable material at least within the zone of the electrical resistor element, as this is the precondition for separating the helmet shell at low energy application.

What is claimed is:

1. Protective helmet with a helmet shell having at least one separating line thereon, said shell being resistant to mechanical stress and formed of a material resistant to melting over a substantial area thereof, comprising an elongate separating device in the form of an electrical resistor element connected to the helmet shell and extending along said at least one separating line of the helmet shell which consists at least partially of easily meltable material, said separating device being provided with at least two electrical terminals to which an electric current source is connectable.

2. Protective helmet according to claim 1, wherein at least one of the separating lines of the helmet shell is arranged so that it extends in a separating plane positioned essentially vertically to the longitudinal axis of the helmet shell and at least approximately in the longitudinal center thereof.

3. Protective helmet according to claim 1, wherein the helmet shell consists of only one separating zone incorporating the resistor element and composed of a material comparatively easy to melt, while the remaining zones of the helmet shell are composed of a material which is comparatively difficult to melt.

4. Protective helmet according to claim 1, wherein the helmet shell is composed of thermoplastic plastic material.

5. Protective helmet according to claim 1, wherein the electrical resistor element is an element selected from the group consisting of resistance wires and resistance strips.

* * * * *